United States Patent [19]

Baus

[11] Patent Number: 4,520,608

[45] Date of Patent: Jun. 4, 1985

[54] STRUCTURAL ASSEMBLY FOR SHOWER PARTITION OR THE LIKE

[76] Inventor: Heinz G. Baus, Wartbodenstrasse 35, CH-3626 Hünibach/Thun, Switzerland

[21] Appl. No.: 509,864

[22] Filed: Jun. 30, 1983

[30] Foreign Application Priority Data

Jul. 2, 1982 [DE] Fed. Rep. of Germany ..... 3224716

[51] Int. Cl.[3] ..... E04F 19/02

[52] U.S. Cl. ..... 52/718; 4/607; 4/610; 4/612; 16/95 D; 160/38; 403/329

[58] Field of Search ..... 4/557, 558, 605, 607, 4/608, 612, 614, 610; 16/87.4 R, 94 D, 95 D; 160/38, 39; 403/326, 327, 329, 331, 363; 52/716–718

[56] References Cited

U.S. PATENT DOCUMENTS

| | | | |
|---|---|---|---|
| 2,501,940 | 3/1950 | Hibbard | 403/329 |
| 3,239,255 | 3/1966 | Murcott | 403/329 |
| 3,526,040 | 9/1970 | Young | 403/327 |
| 4,011,635 | 3/1977 | Meyer | 52/718 |
| 4,265,383 | 5/1981 | Ferguson | 52/718 |
| 4,316,295 | 2/1982 | Whitney | 4/614 |

FOREIGN PATENT DOCUMENTS

| | | |
|---|---|---|
| 891820 | 5/1982 | Belgium . |
| 2102201 | 7/1972 | Fed. Rep. of Germany . |
| 352800 | 11/1956 | Switzerland . |

*Primary Examiner*—Stephen Marcos
*Assistant Examiner*—Linda J. Sholl
*Attorney, Agent, or Firm*—Schwartz, Jeffery, Schwaab, Mack, Blumenthal & Evans

[57] ABSTRACT

A structural assembly, more particularly for a shower partition, comprising a sectional rail having, in one of its outer surfaces, an undercut first channel of which the sides form two lateral grooves. Inserted into this channel, is a facing panel, a resilient connecting element being provided for retention and engagement in the grooves. In order to obtain a structural assembly of small depth, together with reliable and rapid attachment, the facing panel is provided with a longitudinal second channel extending in the direction of its longitudinal axis and undercut along the channel sides to form grooves. The connecting element is arranged at least partly in the second groove where it is held by the undercut second grooves. The connecting element has a lateral projection which extends into one of the first grooves of the sectional rail. Projecting into the other groove of the sectional rail is either a shoulder of the facing panel or a second lateral projection of the connecting element.

17 Claims, 5 Drawing Figures

FIG. 2
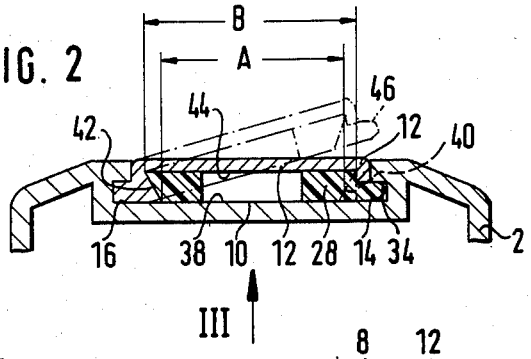
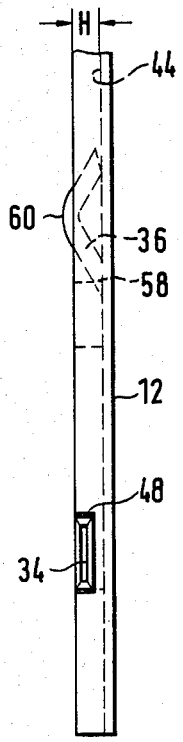
FIG. 4
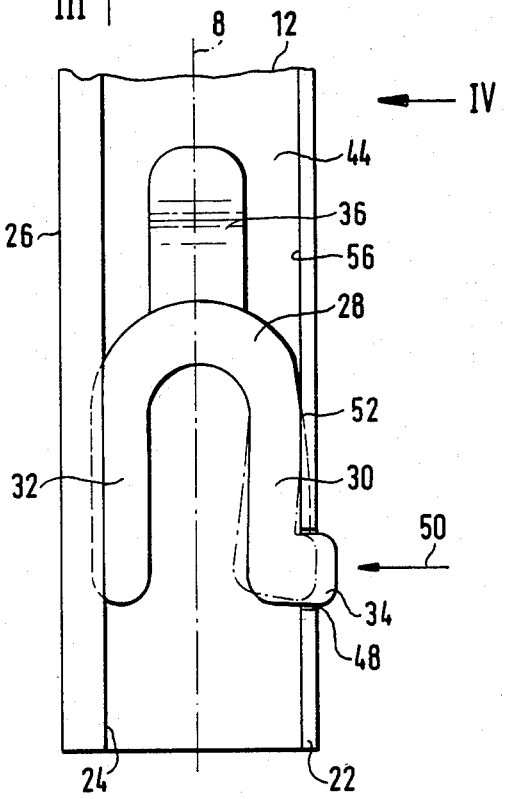
FIG. 3

STRUCTURAL ASSEMBLY FOR SHOWER PARTITION OR THE LIKE

The present invention relates to a structural assembly, for particular use in a shower partition, comprising a support member in the form of sectional rail having, in one of its outer surfaces, a first elongated channel in which is secured, by means of at least one resilient connecting element, a facing panel member.

A structural assembly of this kind for a shower partition is described in German Utility Model No. 80 13 940. In the latter, the visible outer surface of the sectional rail or support member facing the observer comprises a guide channel into which is inserted a facing panel made of plastic, wood, or the like. The guide channel is provided with undercut grooves to allow the facing panel to be secured by means of a resilient connecting element. The connecting element as well as the facing panel are of considerable dimension at right angles to the outer surface of the support member, as a result of which the space available inside thereof is correspondingly small.

In view of the predetermined structural dimension of the support member, the structural volume and depth of the assembly as a whole must be correspondingly great. This requires an appreciable amount of material, as a result of which the material costs, on the one hand, and the overall weight, on the other hand, of the structural assembly are correspondingly high.

It is the purpose of the invention to provide a structural assembly of the type in question at low cost and in such a manner that fitting of the facing panel in the support members requires only a comparatively small structural depth. A reliable and functional attachment of the facing panel in the support member is sought together with inexpensive large-scale production, especially of the connecting element. It is to be possible to fit the facing panel simply and reliably to the support member, the facing panel, if necessary, to be also easily detachable. It is to be a simple matter to replace the facing panel with another one at any time.

In order to accomplish this object, it is proposed that the facing panel be undercut to provide a longitudinal channel extending in the direction of its longitudinal axis; that the connecting element be mounted at least partly in this longitudinal channel and be retained therein by grooves undercut in the sidewalls of the channel. Furthermore, a lateral projection on the connecting element extends into a groove undercut in the support member, while either a shoulder of the facing panel, or a second lateral projection of the connecting element, extends into another groove undercut in the support member.

The structural assembly according to the invention is of simple and inexpensive construction. The inside of the undercut longitudinal channel, extending in the facing panel in the direction of its longitudinal axis, serves to accommodate and secure the connecting element, so that the combined depth of the said facing panel and connecting element is correspondingly small. The grooves formed in the sidewalls of the longitudinal channel of the facing panel ensure reliable attachment of the connecting element to the facing panel. In order to secure the connecting element in relation to the support member, the connecting element comprises a lateral projection which extends into the above-mentioned groove of the support member and is firmly anchored therein. Connection of the facing panel is also effected by an opposing groove of the support member, the facing panel engaging either directly into it by means of a shoulder or indirectly through a second projection on the connecting element to which the support member is connected at that point. In the structural assembly according to the invention, the mounting and assembly may be carried out very simply and very accurately, since the shoulder of the facing panel, or the second lateral projection, is placed in the channel of the support member. This permits specific axial positioning of the facing panel with respect to the sectional rail. Thereafter, the facing panel is pressed into the channel in such a manner that the first lateral projection on the connecting element also engages in the side groove of the support member. According to the invention, therefore, both the support member and the facing panel comprise channel sidewall undercut grooves ensuring a reliable and functional connection. It is expressly emphasized at this point that insertion of the facing panel itself can be carried out in a simple manner, and without special tools or aids, when the structural assembly is incorporated into a finished product, more particularly a shower partition.

If the outer lateral surface or top ridge of the projection on the connecting element is provided with a rounded contour, incorporation into the support member is greatly facilitated and the danger of damage is reduced. In one desirable configuration, the facing panel comprises two flanges extending in the longitudinal direction. Moreover, in at least one of these flanges it is desirable to provide a through slot for the projection on the connecting element. This is a simple way of achieveing alignment and presetting in order to facilitate assembly. Once the assembly is completed, the projection also engages reliably in an associated groove of the channel of the support member.

In one desirable embodiment, the connecting element is U- or stirrup-shaped in plan view, with two legs. If the facing panel comprises the shoulder mentioned above, the projection is arranged upon the opposite leg of the U-shaped connecting element. In an alternative embodiment, a projection is provided on each of the two legs of the U-shaped connecting element, the projections engaging in respective grooves of the channel of the support member. A connecting element of this kind provides a good spring action, thus ensuring that the projection, or projections, engage reliably and firmly in the grooves, of the support member. The two legs have a comparatively large spring deflection and there is no problem in determining the length of the legs to achieve the desired spring force.

According to another embodiment, the connectng element comprises a resilient extension pressing substantially perpendicularly upon the web of the channel of the support member. This is a simple way of bracing the facing panel and the support member together, so that any play arising from production tolerances is compensated for in a simple manner. The desired spring action may be predetermined with little effort by bending this resilient extension in at least one location in relation to the inner surface of the facing panel.

Accordingly, what is broadly claimed herein is a structural assembly, for shower partition or the like, comprising:

a support member having an elongated first channel defined by a first bottom web and first side flanges, said first side flanges forming opposed first grooves facing one another over said first web;

an elongated U-shaped panel member having a second channel defined by a second bottom web and second side flanges, said second side flanges forming second grooves facing one another over said second web; said panel member being dimensioned for snuggly fitting into said first channel with said first and second webs if facing relation;

a connecting element having a resilient portion and side edges fitting into said second grooves whereby said connecting element is retained in said second channel between said first and second webs, said panel member and connecting element thereby forming an integrated panel assembly;

a first lateral projection formed on said resilient portion of said connecting element, and wherein one of said of second side flanges is formed with a through slot for the resilient engagement thereacross of said first projection, said first projection having a length sufficient for reception thereof into one of said first grooves adjacent said one of said second side flanges, and a second lateral projection on said panel assembly receivable in the other of said first grooves, whereby said panel assembly is removably secured in said first channel by said projections lodged in said first grooves, respectively.

Preferred embodiments of the structural assembly according to the invention are illustrated in the drawing attached hereto, wherein:

FIG. 2 is a partial cross-section through a structural assembly with a somewhat modified support member corresponding to a cross-section along the line II—II of FIG. 1;

FIG. 3 is a plan view of the facing panel and connecting element in the direction III shown in FIG. 2;

FIG. 4 is a view in the direction IV shown in FIG. 3; and

Figure 1:
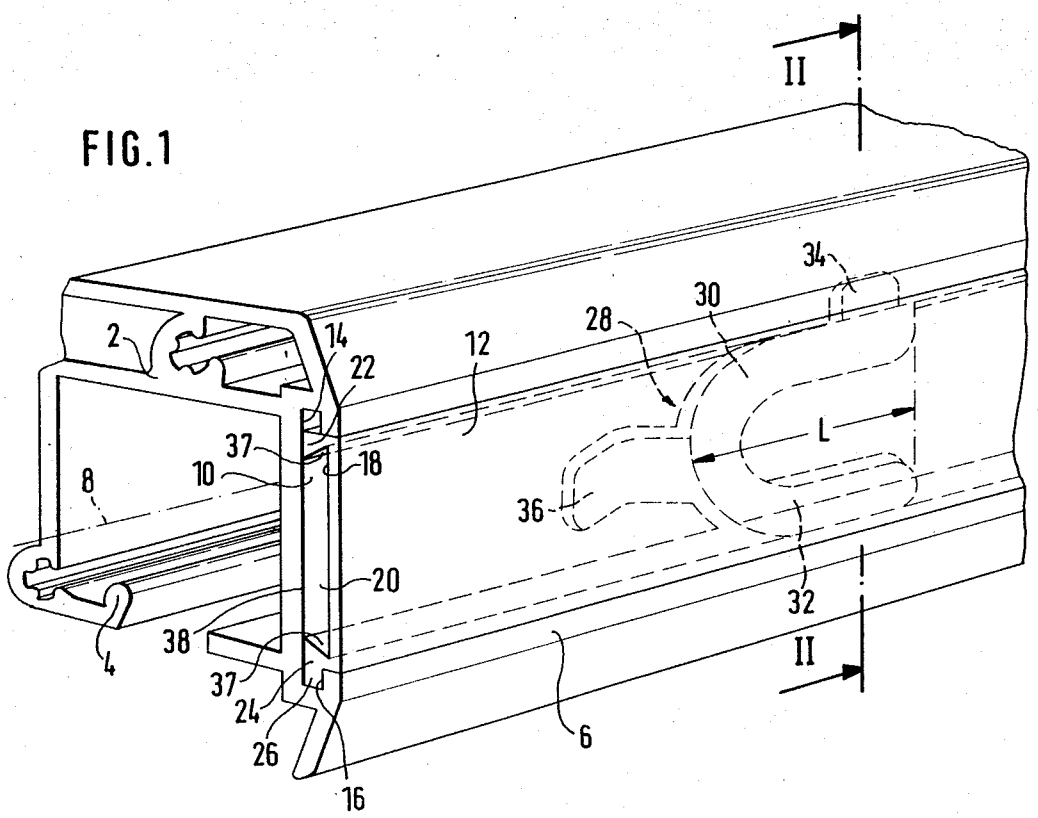
FIG. 1 is a diagrammatic perspective view of a structural assembly made according to the invention.

FIG. 1 is a diagrammatic illustration of a support member in the form of a sectional rail 2 designed as an upper guide-rail for a shower partition. Located inside the sectional rail 2 is a guide-track 4 upon which are mounted rollers or the like, not shown, for the attachment of a sliding door, as known. Other correspondingly designed guide-tracks may be provided, but are not shown here. On its outer face 6, visible for example to an observer, the sectional rail 2 is formed with a first channel 10, extending in the direction of the longitudinal axis 8, into which channel 10 a facing panel 12 is inserted. The first channel 10 has two first grooves 14,16 undercut in its side flanges.

The facing panel 12 is approximately U-shaped in cross section and comprises a longitudinal second channel 18 forming an internal space 20. The longitudinal channel 18 has a bottom web and its side flanges 22, 24, are undercut to define two dove-tailed grooves 37 having inner surfaces arranged at an angle of less than 90° to the web 44 of the longitudinal channel 18. The side flange 24 of the facing panel 12 further defines a shoulder 26 extending in the direction of the longitudinal axis 8. This shoulder 26 engages in the groove 16 of the above-mentioned first grooves 14, 16, so that the facing panel 12 is secured to, and locked in, the sectional rail 2 along this side of the first channel 10. Arranged in the internal space 20 is a connecting element 28 having a length L in the direction of the longitudinal axis 8. For the sake of clarity, only a short length of the sectional rail 2 is shown here, but several such connecting elements 28 are provided over the full length of the sectional rail. The connecting element 28 has two legs 30,32 running approximately parallel with the longitudinal axis 8, a lateral projection 34 being provided upon one leg 30. This projection 34 engages in the first groove 14. As will be explained hereinafter, the outer lateral surfaces or edges of the connecting element 28 are tapered to suit the dove-tail configuration of longitudinal channel 18 of the panel member 12. This ensures a positive and a frictional connection between the facing panel 12 and the connecting element 28. The latter is made of an elastic, resilient material, comparatively large spring-deflections being provided commensurate with the length L of legs 30, 32. This provides, on the one hand, for the simple insertion and dove-tailing of the connecting element 28 into the longitudinal chanel 18 and, on the other hand, for the firm reliable engagement of the projection 34 in the first channel 10. As already indicated, the shoulder 26, of the facing panel 12 engages in the first groove 16. Since, on the other side, the projection 34 of the connecting element 28 also engages in the first groove 14, this obviously provides reliable attachment of the facing panel 12 in the sectional rail 2.

The connecting element 28 also has a resilient spring blade extension 36 which acts approximately perpendicularly upon the web 38 of the channel 10. Bracing is thus also obtained perpendicularly to the web 38 and to outer surface 6 of the sectional rail 2.

The longitudinal channel 18 of the facing panel 12 is undercut to form opposing second grooves 37 and the connecting element 28 is held by wall surfaces of the grooves 37. In the configuration shown, the grooves 37 have wall surfaces that are inclined in relation to the bottom web 44 of the second channel 18 and connecting element 28 also comprises correspondingly inclined lateral surfaces. Here again, longitudinal second channel 18 is of dove-tailed configuration but, within the scope of the invention, may also be of some other configuration, for example T-shaped or with rounded off wall-surfaces. In any case it is essential that connecting element 28 be anchored in the second longitudinal channel 18 on the basis of the undercut configuration of the flanges 22, 24, thereof. Connecting element 28 is in turn anchored in the first channel 10 of the sectional rail 2, which means that the facing panel 12 is positively and frictionally secured in the sectional rail 2.

FIG. 2 is a partial cross section through a somewhat modified sectional rail, corresponding to a cross section along the line II—II of FIG. 1. The shapes of the first channel 10, facing panel 12, and connecting element 28 are as in the embodiment according to FIG. 1. The outer lateral surfaces 40, 42 of the connecting element 28 are tapered whereby the edges of element 28 along the web 38 of longitudinal channel 10, are spaced apart a distance A which is less than distance B between the edges along the inner surface or web 44 of the facing panel 12. The latter, partly inserted into the sectional rail 2, is shown in dot-and-dash lines, together with the connecting element 28. As may be seen, the top ridge 46 of the projection 34 is rounded in cross section. The facilitates, not inconsiderably, the insertion and removal of the facing panel 12 into and out of the sectional rail 2.

FIG. 3 is a plan view of the facing panel 12 and the inserted connecting element 28, as seen in the direction of the inner surface or web 44. Extension 36 runs in the direction of the longitudinal axis 8, in a direction opposite to that of the legs 30, 32. As may be seen, the shoulder 26 and the flange 24 are together wider than the oppose leg 22 of the facing panel 12. The width of the extension 36, at right angles to the longitudinal axis 8, corresponds to the free space between the legs 30, 32, which saves material in the production of such connecting elements. The projection 34 projects through a slot 48 in the leg 22, which allows the projection 34 to engage, in the manner described above, in the first groove 14 in the sectional rail 2. Compressing legs 30, 32 in the direction of arrow 50 allows the connecting element 28 to be removed from or inserted into the facing panel 12. Particular reference is made at this time to the chamfered lateral surface 52 of the connecting element 28. The "compressed" position of leg 30 is indicated in dotted lines; at this time, the chamfered lateral surface 52 is located below the edge 56 of the leg 22, allowing the connecting element 28 to be removed quite easily from the facing panel 12. The connecting element 28 therefore need not be slid into the facing panel 12 along the direction of the longitudinal axis 8. Rather, it may quite easily be inserted in the longitudinal second channel 18 by movement at right angles to inner surface of the second web 44.

The slot 48 for the projection 34 may be seen quite clearly in FIG. 4. In relation to the surface of the connecting element 28 and the inner web surface 44, the resilient extension 36 is bent twice at 58 and 60. When the facing panel 12, with connecting element 28, has been inserted, in the manner explained hereinbefore, into a sectional rail, resilient extension 36, thus designed, braces the facing panel to the sectional rail at right angles to the visible outer surface thereof. The height H of the connecting element 28 corresponds to the depth of the longitudinal channel 18 facing panel 12. The overall external height is therefore not influenced by the connecting element 28.

Figure 5:
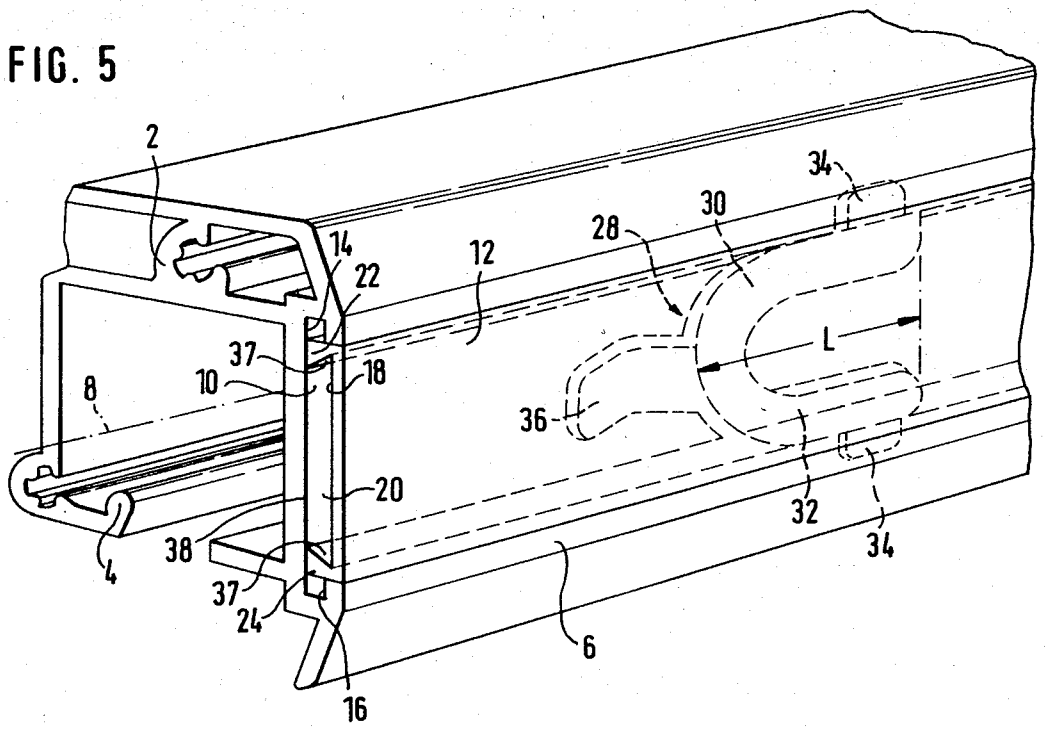
FIG. 5 is a perspective view of an alternative embodiment of the structural assembly of FIG. 1.

FIG. 5 illustrates an alternative embodiment of the structural assembly wherein facing panel 12 has no lateral shoulder such as 26 in FIG. 1 but the connecting element 28 has a second projection 34 on the leg 32. Components similar in design to those in FIG. 1 need not be described again. In this case, the projection 34 of the leg 32 engages in the first groove 16, as in the case of the projection 34 of the leg 30. In internal space 20 of longitudinal second channel 18, the connecting element 28 bears against inclined and undercut wall-surfaces 37 thereof. The connecting element 28 is therefore seated firmly in the longitudinal second channel 18. Projections 34 pass through legs 22, 24 of facing section 12 by slots 48, as explained hereinbefore in conjunction with FIGS. 3 and 4, and project into the first grooves 14, 16.

I claim:

1. A structural assembly comprising:

a support member having an elongated first channel defined by a first bottom web and first side flanges, said first side flanges forming opposed first grooves facing one another over said first web;

an elongated U-shaped panel member having a second channel defined by a second bottom web and second side flanges, said second side flanges being undercut by inwardly inclined inner surfaces forming dove-tail grooves facing one another over said web; said panel member being dimensioned for snuggly fitting into said first channel with said first and second webs in facing relation;

a connecting element having a resilient portion and outwardly inclined chamfered side edges fitting into said undercut dove-tail grooves whereby said connecting element is retained in said second channel between said first and second webs, said panel member and connecting element thereby forming an integrated panel assembly;

a first lateral projection formed on said resilient portion of said connecting element, and wherein one of said second side flanges is formed with a through slot for the resilient engagement thereacross of said first projection, said first projection having a length sufficient for reception thereof into one of said first grooves adjacent said one of said second side flanges, and a second lateral projection on said panel assembly receivable in the other of said first grooves, whereby said panel assembly is removably secured in said first channel by said projections lodged in said first grooves, respectively.

2. A structural assembly as claimed in claim 1, wherein said first projection has a top ridge rounded in cross section for facilitating insertion thereof in and through said slot and into said one of said first grooves.

3. A structural assembly as claimed in claim 1, wherein said resilient portion of said connecting element is in the form of a saddle having resilient side legs fitting at least partially into said dove-tail grooves.

4. A structural assembly as claimed in claim 3, wherein said connecting element is formed with a spring blade extension projecting away from said resilient saddle, said spring blade extension pressing said panel member away from said support member to firmly hold said panel member in said first channel.

5. A structural assembly as claimed in claim 4, wherein said spring blade extension has a bent out portion having a height exceeding the depth of said second channel when said panel assembly is removed from said support member whereby to be at least partially flattened out when said panel assembly is mounted in said first channel.

6. A structural assembly as claimed in claim 1, wherein said second lateral projection of said panel assembly is formed on said resilient portion of said connecting element and wherein the other of said second side flanges is formed with a through slot for the resilient engagement thereacross of said second projection, said second projection having a length sufficient for reception thereof into the other of said first grooves adjacent the other of said second flange.

7. A structural assembly as claimed in claim 1, wherein said second projection is a shoulder formed on the other of said second flange, outwardly thereof with respect to said second channel, and having a size to fit into said other of said first grooves.

8. A structural assembly as claimed in claim 1, wherein said connecting element lies against both the bottom web of said support member and the bottom web of said panel member.

9. A structural assembly comprising:

a support member comprising an elongated support channel defined by a support channel bottom web and support side flanges forming opposed support channel grooves facing each other across said support channel bottom web;

a panel member comprising an elongated U-shaped member dimensioned to snuggly fit into said support channel and comprising a panel channel defined by a panel channel bottom web and panel side flanges forming opposed panel channel grooves;

at least one resilient connecting element resiliently retained in said panel channel by engagement with said opposed panel channel grooves and having at least one lateral projection thereon of sufficient length to extend through an opening in an adjacent panel side flange and engage one of said support channel grooves to hold said panel member in said support channel, said connecting element further comprising a resilient extension configured to extend out of said panel channel when said panel member is removed from said support channel and resiliently engaging said support channel bottom web to brace said panel member with respect to said support channel bottom web when said panel member is mounted in said support channel.

10. A structural assembly as claimed in claim 9, wherein said connecting element comprises a saddle having side legs resiliently fitting into said opposed panel channel grooves, and said resilient extension comprises a bent spring blade extension projecting from said saddle and having a height exceeding the depth of said panel channel, said spring blade extension being at least partially flattened out when said panel member is mounted in said support channel.

11. A structural assembly as claimed in claim 10, wherein said spring blade extension projects from the middle of the bight of said saddle joining said side legs.

12. A structural assembly as claimed in claim 11, wherein said panel channel grooves are V-shaped in cross section and the outer edges of said resilient side legs of said connecting element are chamfered to fit into said in V-shaped grooves.

13. A structural assembly as claimed in claim 12, wherein said saddle side legs are spaced apart a predetermined distance and the width of said spring blade extension is equal to or less than said distance.

14. A structural assembly as claimed in claim 12, wherein said resilient side legs of said saddle and said panel channel grooves form dove-tail joints.

15. A structural assembly comprising:

a support member comprising an elongated support channel defined by a support channel bottom web and support side flanges forming opposed support channel grooves facing each other across said support channel bottom web;

a panel member comprising an elongated U-shaped member dimensioned to snuggly fit into said support channel and laterally insertable without deformation thereof into said support channel, said U-shaped member comprising a panel channel defined by a panel channel bottom web and panel side flanges forming opposed panel channel grooves, at least one of said panel side flanges being configured to define at least one opening therethrough leading from said panel channel to one of said support channel grooves when said panel member is inserted in said support channel, and at least one connecting element resiliently retained in said panel channel by engagement with said opposed panel channel grooves and having at least one lateral projection thereon extending through said opening through said one panel side flange into said one support channel groove when said panel member is inserted in said support channel to secure said panel member against lateral removal from said support channel, said connecting element being fully concealed from view when said panel member is inserted in said support channel.

16. A structural assembly as claimed in claim 15, wherein said panel member comprises a shoulder on one of said panel side flanges which engages the other of said support channel grooves when said panel member is inserted in said support channel.

17. A structural assembly as claimed in claim 15, wherein each of said panel side flanges is configured to define an opening therethrough leading to an adjacent support channel groove, and said connecting element has two lateral projections, one of said projections extending through each of said openings into the adjacent support channel groove when said panel member is inserted in said support channel.

* * * * *